US007191755B2

(12) United States Patent
Vint

(10) Patent No.: US 7,191,755 B2
(45) Date of Patent: Mar. 20, 2007

(54) IDLE AIR CONTROL VALVE STEPPER MOTOR INITIALIZATION TECHNIQUE

(75) Inventor: Matti K. Vint, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/180,802

(22) Filed: Jul. 13, 2005

(65) Prior Publication Data

US 2007/0012286 A1 Jan. 18, 2007

(51) Int. Cl.
*F02D 41/08* (2006.01)
*F02M 3/08* (2006.01)

(52) U.S. Cl. ..... 123/339.26; 123/339.14

(58) Field of Classification Search ..... 123/339.14, 123/339.23, 339.25–339.27, 585
See application file for complete search history.

(56) References Cited

U.S. PATENT DOCUMENTS

| | | | | |
|---|---|---|---|---|
| 3,704,702 | A | 12/1972 | Aono | 123/179.16 |
| 4,094,292 | A | 6/1978 | Takagi et al. | 123/179.18 |
| 4,337,742 | A | 7/1982 | Carlson et al. | 123/339.17 |
| 4,359,983 | A | 11/1982 | Carlson et al. | 123/339.26 |
| 4,391,244 | A * | 7/1983 | Kobashi et al. | 123/339.26 |
| 4,392,468 | A * | 7/1983 | Kobashi et al. | 123/339.26 |
| 4,711,744 | A | 12/1987 | Scott et al. | 261/64.4 |
| 4,915,085 | A | 4/1990 | Staerzl | 123/587 |
| 5,065,718 | A * | 11/1991 | Suzuki et al. | 123/339.25 |
| 5,150,673 | A | 9/1992 | Hoshiba et al. | 123/179.15 |
| 5,469,827 | A | 11/1995 | Tomisawa | 123/491 |
| 5,520,150 | A * | 5/1996 | Kimoto | 123/339.26 |
| 5,687,682 | A | 11/1997 | Rembold et al. | 123/179.3 |
| 6,539,918 | B1 * | 4/2003 | Pursifull | 123/399 |
| 6,758,202 | B2 | 7/2004 | Russell et al. | 123/685 |
| 6,769,388 | B2 | 8/2004 | Watanabe et al. | 123/179.18 |
| 6,779,510 | B2 | 8/2004 | Russell | 123/406.47 |
| 2002/0179031 | A1 | 12/2002 | Slopsema et al. | 123/192.1 |
| 2003/0213454 | A1 | 11/2003 | Grieser et al. | 123/179.18 |
| 2004/0173183 | A1 * | 9/2004 | Yu et al. | 123/399 |
| 2004/0221837 | A1 | 11/2004 | Kassner | 123/565 |

FOREIGN PATENT DOCUMENTS

| | | | | |
|---|---|---|---|---|
| JP | 02-055871 | * | 2/1990 | 123/339.26 |

* cited by examiner

*Primary Examiner*—T. M. Argenbright
(74) *Attorney, Agent, or Firm*—Brinks Hofer Gilson & Lione

(57) ABSTRACT

A system for controlling idle air flow for an engine. The system includes an idle air control valve, a stepper motor, and a controller. The idle air control valve has a first hard stop and a second hard stop. The stepper motor is coupled to the idle air control valve and configured to manipulate the position of the idle air control valve. The controller is in communication with the stepper motor to provide a driving signal. Further, the controller is configured to drive the idle air control valve to the first hard stop and then drive the idle air control valve to the second hard stop after receiving an engine shutdown command.

10 Claims, 4 Drawing Sheets

IDLE AIR CONTROL VALVE STEPPER MOTOR INITIALIZATION TECHNIQUE

BACKGROUND

1. Field of the Invention

The present invention generally relates to a system and method for controlling an idle air control valve. Recreational vehicles have different performance and cost requirements from typical automotive applications. This can create unique problems for recreational vehicles particularly during engine start and engine shutdown.

2. Description of Related Art

During engine shutdown NVH (engine shake, piston bounce back) can be a problem. With recreational vehicles this can be quite noticeable given the very close proximity of the engine relative to the driver/rider and the reduced compliance within the engine mount structure. Engine mounts are minimal or non-existent in recreational vehicles to minimize engine roll issues during tip-in and tip-out and because the engine is often part of the structural frame to reduce weight.

Engine starts are less reliable with recreational vehicles because they have fewer cylinders. Fewer cylinders requires a greater rotation before having a cylinder in the proper position to provide power to assist start the engine. In addition, the delay between each subsequent combustion event is longer, thereby making the first combustion event even more critical to engine start.

Many recreational vehicles require a kick or pull start by the operator, which can be highly variable and directly impacts customer satisfaction if the engine is difficult to start. For other systems with electric start, the battery is typically very small and often in a discharged state or poor condition because of the intermittent operational usage of recreational vehicles. ATV's are often used on the snow where the colder temperature also reduces battery performance. These factors give rise to a much higher probability of poor engine starts.

Recreational vehicles tend to have very small plenums such that when the engine commences to rotate during crank the engine creates a higher vacuum in the intake manifold/plenum. The higher vacuum increases the pumping losses so that for a given starting torque the engine will be slower to accelerate and not reach as high a cranking speed over a given time or angular rotation, thereby impacting start performance. Also a higher load impacts the starting feel and effort required for manual pull or kick starts. A conventional automotive application has a large plenum so the pressure is higher which results in better filling of the cylinder during crank, providing higher combustion pressures, higher torque and better engine starts. Conversely recreational applications have reduced cylinder filling during crank resulting in lower cylinder pressure, lower starting torque, and poorer starts in comparison. Both ATV and snowmobiles are required to start reliably and quickly in very cold environments. Unlike their automotive car counterparts they do not have engine block heaters for colder weather operation and are typically used well away from even basic facilities.

Many of the engine start and shut down problems can be addressed by manipulating the idle air control (IAC) valve. Unlike their automotive counterparts, stepper motor IAC valves on recreational vehicles do not have return spring functionality, because the friction from the lead screw that is required to reduce stepper motor torque requirements will not allow the motor to freewheel. This means that prior to starting the engine the stepper motor needs to find a new reference position or use a good last known valve. Finding a new reference during engine start adds a delay to the initialization process. System reliability may be reduced due to the need to drive the motor until the valve hits a hard stop.

To reposition a stepper motor IAC valve to a known position typically requires a strategy of purposely moving the motor against the physical stop at least several steps past the expected hard stop position based on referencing from the last known position. The reason for this is that stepper motors invariably miss steps that require the controller to compensate. Unfortunately, if the number of missing steps is unknown then the amount of compensation required must allow for the worst case. Accordingly, many more steps are required against the hard stop adding to reduced reliability. Additional steps are required since IAC valves rarely have the benefit of a feedback position sensor, for cost reasons, and must operate in open loop mode counting steps. Unfortunately this results in two potential issues; (1) increased valve and gear loading by motoring into a hard stop potentially reducing reliability, depending on the magnitude of hard stepping applied and (2) NVH is created while stepping against the hard stop since the IAC valve is located near the rider on recreational vehicles without the benefit of separation by distance and firewall that occurs with typical automotive vehicles. Also this mode would occur during engine off so there will be no masking effect from engine noise.

One proposed solution includes storing the last known position of the IAC valve during engine shut down. However, storing the IAC valve position for use during the subsequent power-up also has a few drawbacks. One problem with using the last known value is that stepper motors invariably miss steps during operation, therefore, long term maintenance of position through step counting can be unreliable. Storing the last known value requires that the power be sustained within the PCM, increasing system cost. Cost and complexity of the system is further increased by requiring non-volatile memory and a strategy to store the last known good value.

Under certain modes, such as idle speed control, there is less need for accurately knowing the actual valve position since the PID feedback loop will, given time, correct for errors. However, in start up mode any valve position inaccuracy will deteriorate system performance of any feedforward logic (e.g. step change in load such as changing from neutral to in gear with clutch engaged, or A/C on conventional vehicles) since these rely on adding or removing a given quantity of air mass to pre-empt the step change and subsequent impact on engine speed. However, the relationship between the number of steps and airflow rate is not linear, therefore, adding an offset based on the perceived number of steps may result in less accuracy. Similarly, adding or removing the required air mass for the given disturbance, may negatively affect performance.

Other modes such as dashpot mode operate entirely using an open loop, where any error in the IAC position will significantly impact performance. For example, if the actual IAC position is greater than expected based on the perceived number of steps then engine run-on can be an issue, as well as, making parking maneuvers more difficult. If actual IAC position is less than expected then there will be an increase in transmission NVH and difficulties fuelling the small air mass leading to potential misfire, reduced performance, and increased hydrocarbon emissions.

Alternatively some other solutions require the controller to measure the time to nominal current for both normal and waste spark to determine CID. For this to occur robustly there needs to be a significant difference in the cylinder pressure during exhaust and compression stroke. For conventional automotive engines with large plenums this is less of a problem but for recreational applications the plenum volume is often so small that cylinder filling is reduced during crank making CID detection less robust.

In view of the above, it is apparent that there exists a need for an improved system and method for controlling an idle air control valve.

SUMMARY

In satisfying the above need, as well as overcoming the enumerated drawbacks and other limitations of the related art, the present invention provides an improved system and method for controlling an idle air control valve.

The present invention is particularly applicable to recreational vehicle market such as motorcycles, ATVs, personal watercraft, and snowmobiles. These applications use single or twin cylinder engines, however, the present invention is also applicable to other automotive applications.

The system manipulates the idle air control valve during the engine shutdown, after the engine has stopped, and during engine start up. During engine shutdown the idle air control (IAC) valve shuts off airflow through the idle air passage. The stepper motor drives the idle air control valve to the zero step position to minimize the idle air bypass flowrate. Minimizing the idle air bypass flowrate reduces NVH and piston bounce back during engine shutdown. Less air into the engine reduces cylinder pressure during the compression stroke and, therefore, reduces piston bounce back.

Further, lost steps are eliminated in the valve closing direction by controlling the IAC valve to the fully closed position during engine shutdown. If steps have been lost in the closing direction then this approach will compensate by driving the valve into a hard stop. Accordingly, the least number of 'over-stepping' steps possible with an open loop positioning system will be used, although it will not fully close the valve if steps were lost in the opening direction.

Once the engine stops, the idle air control (IAC) valve is fully opened. By moving the idle air control valve to the fully open position, the air bypass flowrate is maximized. Lost steps are eliminated in the valve opening direction by controlling the IAC valve to the fully open position. If steps have been lost in the opening direction then this approach will compensate by driving the valve into a hard stop. Accordingly, the 'least' number of steps possible with an open loop positioning system will be used. By controlling the IAC valve back to the fully open reference position during engine shutdown, less initialization time is needed to reposition the valve upon engine start. Also, at the time of engine shutdown, the position of the stepper motor is known and the need for storing the last known position in non-volatile memory is eliminated.

During initial engine crank control, the IAC valve keeps the IAC airflow maximized through the valve for a period of time before ramping down. Accordingly, less power is required during the initial rotation of the engine, since the engine has lower pumping losses. Unlike conventional automotive vehicles with large intake plenums, the recreational vehicles have negligible plenum volume so the pressure drops quickly.

With lower losses during initial rotation the engine will accelerate more quickly during crank, therefore, the engine will be rotating at a higher speed once the fuel and spark commences. As a result of the higher speed, the higher air flow velocity helps provide better air and fuel mixing causing a better engine start, particularly when the engine is cold. Further, torque is increased which can be important in recreational vehicles due to the reduced number of cylinders and combustion events available during start up.

A successful engine start can be measured by monitoring engine speed during the combustion stroke, or after reaching a certain angle after starting (PIP edges since crank). After a successful engine start, the IAC can move back to a lower flowrate value based on idle air charge requirements as a function of temperature and time since engine start. Adjusting the IAC valve position minimizes engine speed flare on start, although engine speed is initially controlled by retarding spark. Retarding the spark provides rapid control response, assists initial warmup, heats up the intake valve faster for improved fuel vaporization, and heats up the exhaust gases to allow the HEGO/EGO enter closed loop fuel control earlier.

Essentially any error created from missing steps is effectively removed by moving the valve fully closed and then fully open. This is achieved with a minimum number of over-steps into the hard stop. Further, the valve is positioned at a known pre-position during the next start to reduce initialization delays and removing the need to store the last known operating position in non-volatile memory. Engine start performance and effort is improved, as well as, providing less variability during engine starts.

Further objects, features and advantages of this invention will become readily apparent to persons skilled in the art after a review of the following description, with reference to the drawings and claims that are appended to and form a part of this specification.

DETAILED DESCRIPTION

Figure 1:
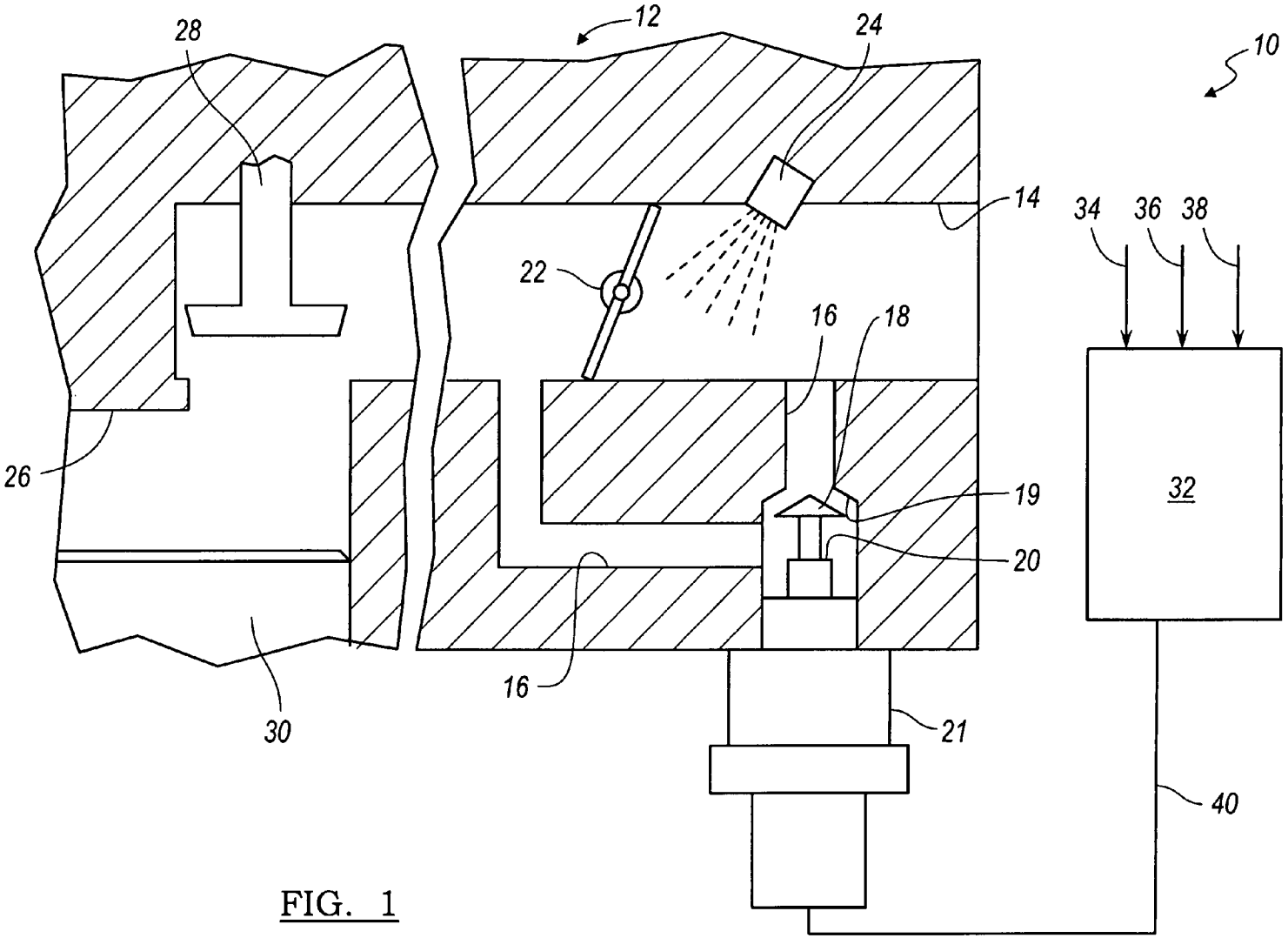
FIG. 1 is a diagrammatic view of a system to control an idle air control valve in accordance with the present invention.

Referring now to FIG. 1, a system embodying the principles of the present invention is illustrated therein and designated at 10. As its primary components, the system 10 includes an engine 12 and a controller 32. The engine 12 includes an air induction passage 14 to provide air for combustion. A throttle 22 controls the amount of air provided through the air induction passage 14 to a cylinder 26. In addition, a idle air bypass passage 16 provides an alternate path to provide air to the cylinder 26 around the throttle 22. In a typical recreational vehicle, the throttle 22 is a mechanically controlled throttle and the air provided at engine idle speed is controlled through the idle air bypass passage 16. The amount of air allowed to flow through the idle air bypass passage 16 is controlled by an idle air control valve 18. The idle air control valve 18 is driven to a position by a stepper motor 21. The stepper motor 21 receives a driving signal 40 from the controller 32. The controller 32 manipulates the position of the idle air control valve 18 based on system parameters such as the engine speed signal 34, a shutdown command signal 36 and a key on command 38. In addition, the idle air control valve 18 interfaces with a first positive stop 19 corresponding to a fully closed position of the idle air control valve 18. A second positive stop 20 is provided corresponding to a fully opened position of the idle air control valve 18.

In addition, the amount of air provided to the cylinder 26 is controlled by an engine valve 28 and synchronized with the motion of the engine piston 30. The air combusts within the cylinder 26 to cause motion of the engine piston 30. A fuel injector 24 provides fuel to the air in the air induction passage 14 creating an air fuel mixture which is later combusted within the cylinder 26, thereby causing motion of the piston 30 that is translated into vehicle motion.

Figure 2:
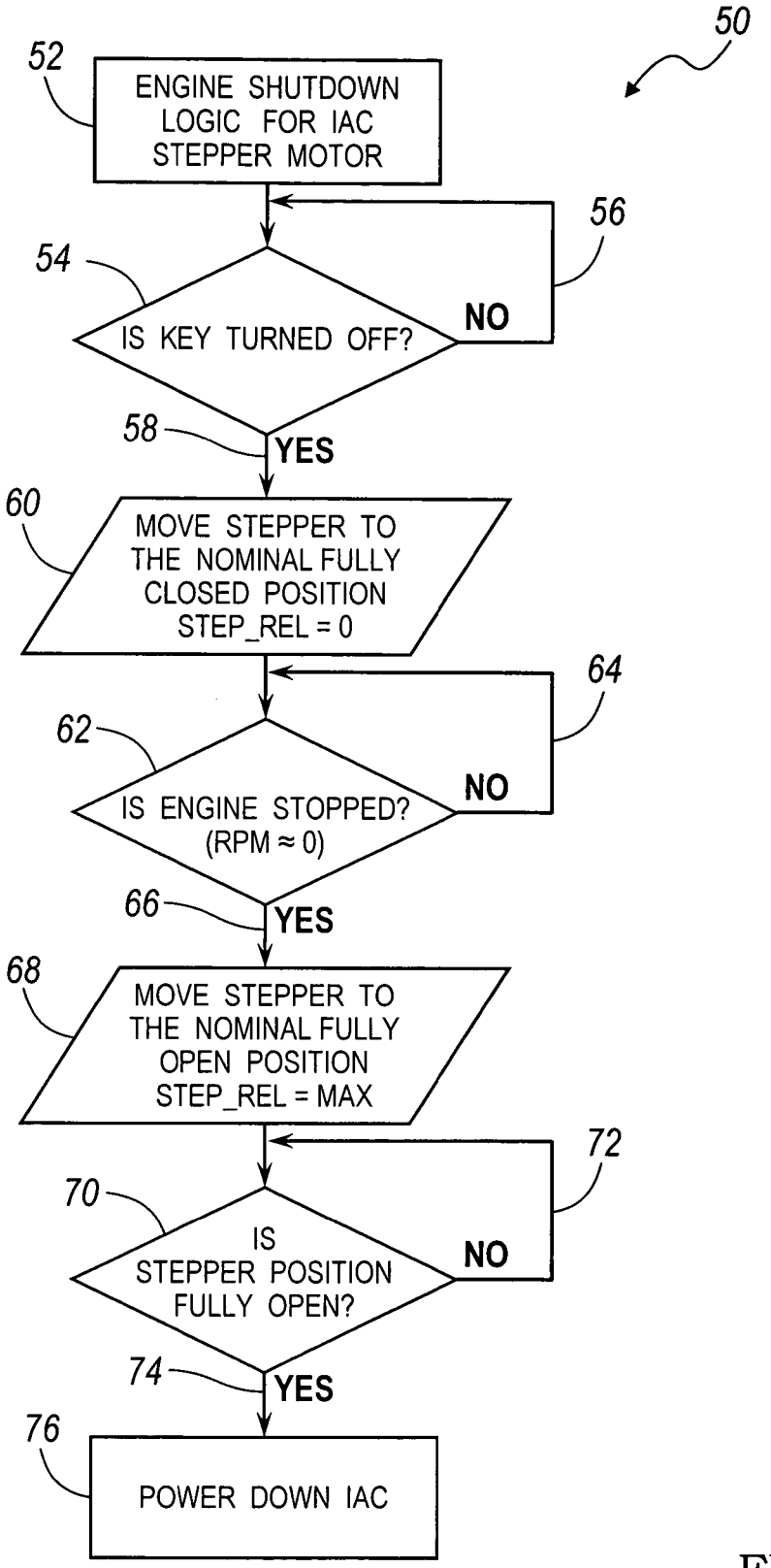
FIG. 2 is a flow chart depicting a method for controlling an idle air control valve during engine shutdown in accordance with the present invention.

Now referring to FIG. 2, a method 50 is provided for engine shutdown. As indicated by block 52, the control logic and the engine controller scans for an engine shutdown signal. As denoted by block 54, the controller evaluates if the engine shutdown signal has been received. If the engine shutdown signal has not been received, the logic flows along line 56 and the controller continues to monitor for the shutdown signal. If the engine shutdown signal has been received, the logic flows along line 58 and the stepper motor drives the idle air control valve to the nominal fully closed position where the step count equals zero. Moving the idle air control valve to the nominally fully closed position minimizes the idle air control air flow to minimize NVH and piston bounceback, thereby minimizing variation in initial piston position at the next engine start. In addition, this removes any missing steps in the opening direction using the minimum number of oversteps possible for an open loop control system.

Next, the controller determines if the engine has effectively stopped as denoted by block 62. If the engine has not effectively stopped, the logic flows along line 64 and the controller monitors the engine speed until the engine has stopped. When the engine is stopped, the logic flows along line 66 to block 68. In block 68, the stepper motor drives the idle air control valve to the fully opened position. Moving the stepper to the nominal fully opened position moves the stepper to a known starting reference position for the next engine start and maximizes the idle air control air flow rate for the next start to improve cranking, as well as reduce time to heat HEGO and catalyst. In addition, moving the stepper to the nominal fully opened position, removes any missing steps in the closing direction using the minimum number of oversteps possible for an open loop control system. In block 70 the controller determines if the stepper position is fully opened. If the stepper position is not at the fully opened stop, the logic flows along line 72 and the idle air control valve position is re-evaluated. If the idle air control valve is re-evaluated in block 70 for longer than a predetermined time period, the controller will time out and an error condition may be generated. When the idle air control valve reaches the fully opened position, the controller logic follows along line 74 and the system is powered down as denoted by block 76.

Figure 3:
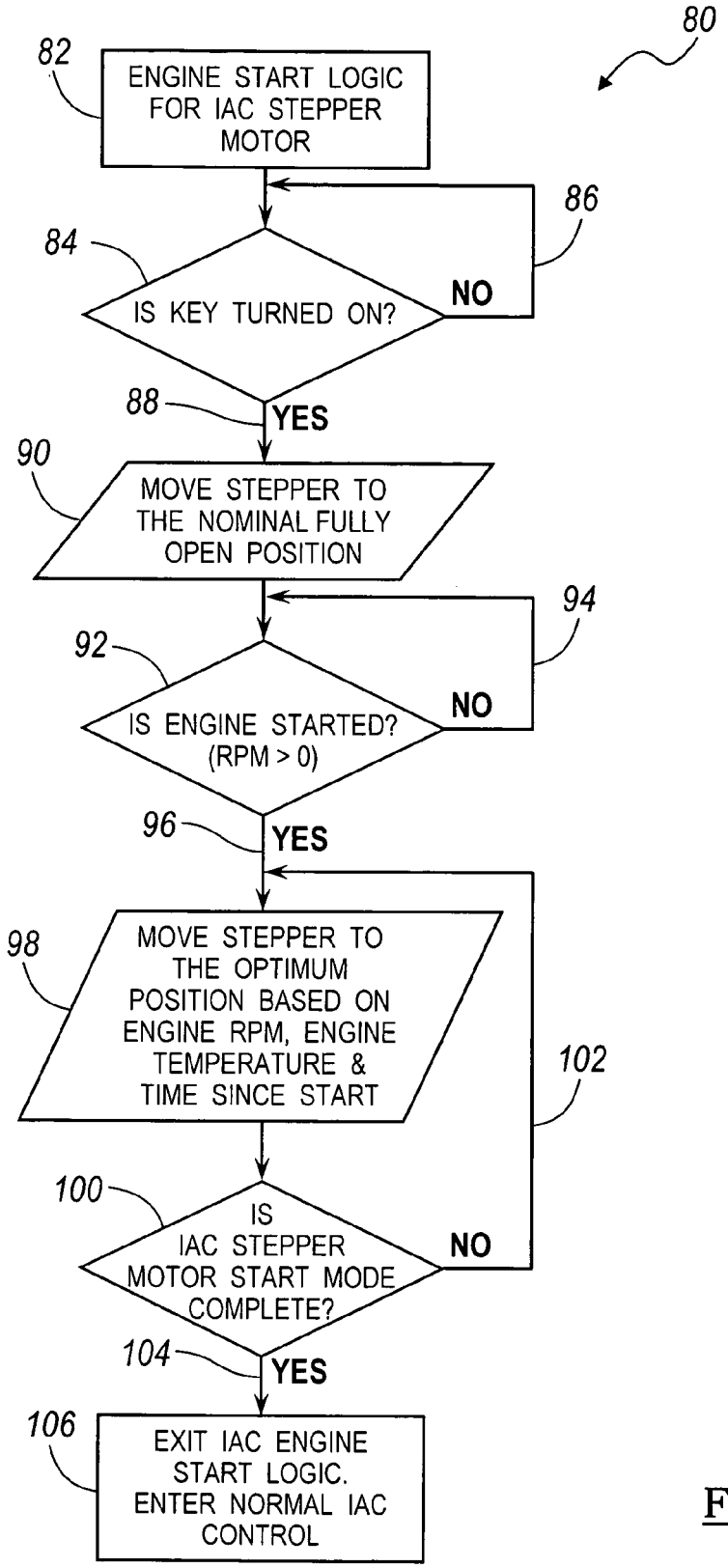
FIG. 3 is a flow chart depicting a method for controlling an idle air control valve during engine startup in accordance with the present invention.

Now referring to FIG. 3, a method 80 for engine start is provided and starts at block 82. In block 84, the controller determines if a startup signal is received. If a startup signal is not received, the controller logic follows line 86 and the controller inputs continue to be monitored in block 84. When the startup signal is received by the controller, the logic follows line 88 and the stepper motor drives the idle air control valve to the fully opened position, as denoted by block 90. In block 92, the controller determines if the engine is started by determining if the engine speed has increased beyond a predetermined threshold. If the engine speed is not increased beyond the predetermined threshold, the controller logic follows line 94 and the controller continues to monitor the engine speed in block 92. When the engine speed exceeds the predetermined threshold, the controller logic follows line 96 to block 98. In block 98, the stepper motor drives the idle air control valve to the optimum position based on engine speed, engine temperature, and the time since engine start.

Thereafter, the stepper motor will continue to dynamically update the idle air control valve position based on engine speed, engine temperature, and time since engine start. Further, the spark ignition timing is adjusted to provide engine speed control and the idle air control valve flow rate is set to provide an adequate retard for heat generation based on the engine temperature, catalyst, and HEGO requirements. Accordingly, the controller maximizes the idle air control valve flow rate to improve cranking and starting capability by increasing the intake manifold pressure, thereby reducing time to heat HEGO and the catalyst. Increasing manifold pressure will reduce the ability to vaporize fuel, if the fuel is injected before the intake valve opens. However, these issues can be avoided by injecting fuel after the intake valve has opened with the piston velocity creating a vacuum to draw the air and fuel into the cylinder. In block 100, the controller determines if start mode is complete and the idle air control valve has been positioned a nominal idle run mode position. If the start mode has not been completed, the controller logic follows along line 102 and the controller continues to drive the idle air control valve based on the engine speed, engine temperature, and the time since engine start. When the start mode has been completed, the controller logic follows along line 104 to block 106 indicating the engine controller enters nominal mode logic control and exits the start mode control logic.

Figure 4:
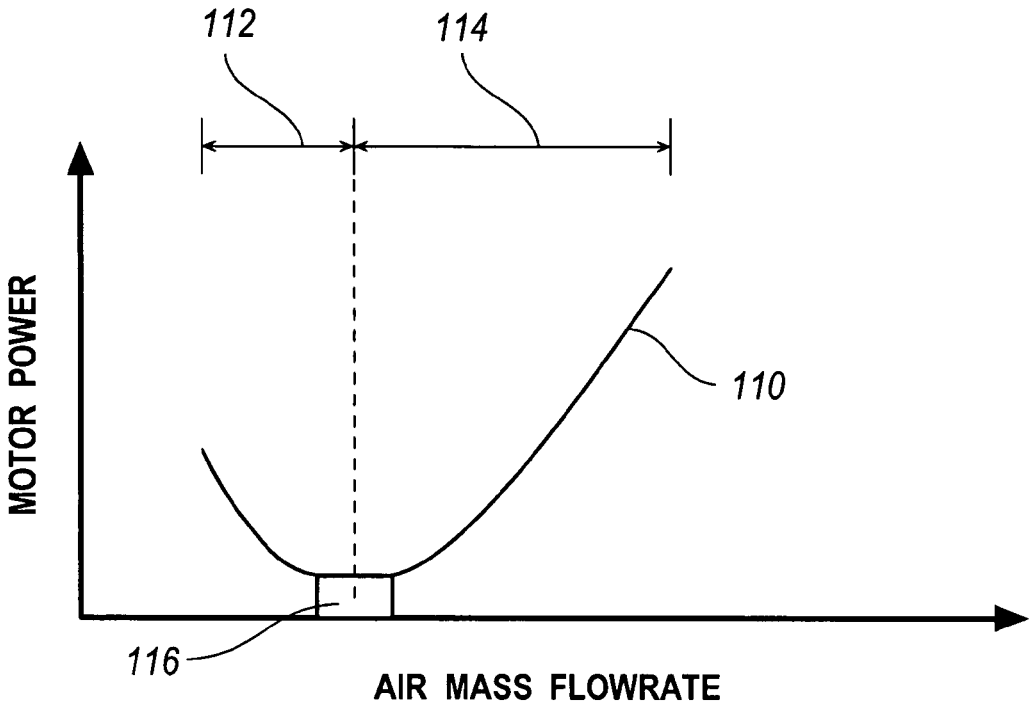
FIG. 4 is a graph of the motor power with respect to air mass flow rate.

Now referring to FIG. 4, a curve 110 corresponding to motor power is provided as a function of air mass flow rate. Region 112 indicates the portion of the curve where the motor power increases as the air mass flow rate decreases. Conversely, region 114 indicates the portion of the curve where the motor power increases as the air mass flow rate increases. Accordingly, the ideal start mode operating region during crank is denoted by block 116.

The method described above provides a very efficient open loop technique to reset the stepper motor position to a known reference without any form of closed loop detection. For example, no stepper motor position feedback sensing or stepper motor stall current detection is required. Further, the technique provides several engine shutdown and startup performance benefits while removing "all" missing steps using a minimum number of steps into a hard stop, this being the offset number of steps existing at the time of engine shutdown.

The following scenario comparison is provided to compare the above described technique against the typical technique of resetting motor position by moving only one direction into a hard stop reference. For this scenario it is assumed the stepper motor only misses five steps, although this can occur in either opening or closing direction. However, the typical worst case condition is that the position reset strategy must compensate for up to 50 lost steps in either opening or closing direction. During a traditional open loop position reset technique, the stepper motor is stepped into the hard reference (fully closed position) to reset its position. To ensure this is effective under most operating conditions it must overstep allowing for the typical worst case, 50 steps in this scenario.

According to the above described technique, the stepper motor moves the idle air control valve to the perceived zero step position. This will remove any error/missing steps in the opening direction between the perceived position and the actual position. Any missing steps that might exist in the opening direction are removed. If missing steps exist in the closing direction then the valve will not be fully closed, albeit close depending on the number of missing steps. Next, the stepper motor moves the idle air control valve to the perceived fully open position. This will remove any error/missing steps in the closing direction between the perceived position and the actual position. Any missing steps that might exist in the closing direction are removed. Accordingly, any missing step errors existing in 'either' direction are automatically removed. The stepper motor then moves the idle air control valve to a nominal position to improve engine start capability.

TABLE 1

| | Existing Designs Resetting on One Hard Stop | | | Proposed Design Resetting on Two Hard Stops | | |
|---|---|---|---|---|---|---|
| Scenario | Over-steps Closing | Over-steps Opening | Total Over-steps | Over-steps Closing | Over-steps Opening | Total Over-steps |
| Stepper position reset if lost 5 steps in closing direction | 50 | N/A | 50 | 5 | 0 | 5 |
| Stepper position reset if lost 5 steps in opening direction | 50 | N/A | 50 | 0 | 5 | 5 |
| Stepper position reset if lost 50 steps in closing direction | 50 | N/A | 50 | 50 | 0 | 50 |
| Stepper position reset if lost 50 steps in opening direction | 50 | N/A | 50 | 0 | 50 | 50 |

As clearly illustrated in Table 1, the proposed reset stepper position technique only over-steps the stepper motor into the hard stop the actual amount required (i.e. actual lost steps) thereby minimizing NVH and maximizing system durability. Unlike the conventional design, it does not need to overstep additional steps to allow for typical worst case. Another benefit is that the proposed technique is robust to changes and is system independent.

During engine shutdown minimizing airflow into the engine will reduce the cylinder compression pressures and, therefore, the amount/severity of piston bounce back. Initially during crank mode, before combustion commences, the engine operates like an air pump, where the power absorbed is a function of air mass flowrate and pressure drop across the pump according to relationship provided in equation 1.

$$(\text{motoring power}) \propto (\text{Flow}) \times (\text{Pressure Drop}) \quad (1)$$

Therefore, to minimize motoring power, one should add additional air through the idle air bypass valve to reduce the pressure drop up to the point where the rate of reduction in pressure drop is less than the rate of increase in airflow.

Adding more air into the cylinder increases the cylinder pressure during compression but does not significantly affect the overall "average" power requirement over a cycle since this compressed air subsequently expands and returns the stored potential energy. Therefore, during crank the stepper motor could dynamically control mass airflow based on engine speed to minimize motoring power. However, in practice a simplification would be to preposition the IAC stepper motor after key-on before engine cranking commences.

As a person skilled in the art will readily appreciate, the above description is meant as an illustration of the principles this invention. This description is not intended to limit the scope or application of this invention in that the invention is susceptible to modification, variation and change, without departing from spirit of this invention, as defined in the following claims.

I claim:

1. A system for controlling idle air flow for an engine, the system comprising:

an idle air control valve having a first hard stop and a second hard stop;

a stepper motor coupled to the idle air control valve to set the position of the idle air control valve;

a controller in communication with the stepper motor to provide a driving signal; and wherein the controller is configured to drive the idle air control valve to the first hard stop and then drive the idle air control valve to the second hard stop after receiving an engine shutdown command.

2. The system according to claim 1, wherein the first hard stop is at a fully closed position of the idle air control valve.

3. The system according to claim 1, wherein the second hard stop is at a fully open position of the idle air control valve.

4. The system according to claim 1, wherein the controller is configured to drive the idle air control valve to the second hard stop based on a key on command.

5. The system according to claim 1, wherein the controller is configured to ramp down the idle air control valve after a key on command is received and the engine speed reaches a predefined threshold speed.

6. The system according to claim 1, wherein the controller is configured to drive the idle air control valve to the second stop after the engine speed has decreased below a predetermined engine speed.

7. The system according to claim 1, wherein the controller is configured to drive the idle air control valve to the second stop after the engine has stopped rotating.

8. A system for controlling idle air flow for an engine, the system comprising:

a throttle valve;

an idle air control valve having a first hard stop at a fully closed position and a second hard stop at a fully open position;

an engine cylinder in fluid communication with the throttle valve and the idle air control valve;

a stepper motor coupled to the idle air control valve to set the position of the idle air control valve;

a controller in communication with the stepper motor to provide a driving signal; and wherein the controller is configured to drive the idle air control valve to the first hard stop at the fully closed position and then drive the idle air control valve to the second hard stop at the fully open position after receiving an engine shutdown command and the engine has stopped rotating.

9. The system according to claim 8, wherein the controller is configured to drive the idle air control valve to the second hard stop based on a key on command.

10. The system according to claim 8, wherein the controller is configured to ramp down the idle air control valve after a key on command is received and the engine speed reaches a p redefined threshold speed.

* * * * *

UNITED STATES PATENT AND TRADEMARK OFFICE

CERTIFICATE OF CORRECTION

PATENT NO. : 7,191,755 B2
APPLICATION NO. : 11/180802
DATED : March 20, 2007
INVENTOR(S) : Matti K. Vint It is certified that error appears in the above-identified patent and that said Letters Patent is hereby corrected as shown below:

Column 10, in claim 10, line 4, after "reaches a" delete "p redefined" and substitute --predefined-- in its place.

Signed and Sealed this

Twenty-sixth Day of June, 2007

JON W. DUDAS
*Director of the United States Patent and Trademark Office*